US007350565B2

(12) United States Patent
Hall et al.

(10) Patent No.: US 7,350,565 B2
(45) Date of Patent: Apr. 1, 2008

(54) SELF-EXPANDABLE CYLINDER IN A DOWNHOLE TOOL

(76) Inventors: David R. Hall, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 172 days.

(21) Appl. No.: 11/307,464

(22) Filed: Feb. 8, 2006

(65) Prior Publication Data

US 2007/0181296 A1 Aug. 9, 2007

(51) Int. Cl.
*E21B 19/16* (2006.01)

(52) U.S. Cl. ..... 166/242.1; 166/380; 204/196.01; 138/137

(58) Field of Classification Search ..... 166/242.1, 166/242.6, 380; 175/320; 204/196.01, 196.15; 138/137, 138, 139, 151
See application file for complete search history.

(56) References Cited

U.S. PATENT DOCUMENTS 1,646,735 A * 10/1927 Mills ..... 205/731
1,646,736 A 10/1927 Mills
1,705,197 A 3/1929 Mills
1,814,183 A 7/1931 Patterson
2,392,033 A 1/1946 Eaton
2,401,546 A 6/1946 Brown
3,186,738 A 6/1965 Dalrymple
3,202,562 A 8/1965 Lang
3,251,427 A 5/1966 Ewing
3,620,555 A 11/1971 Hinds
3,734,181 A 5/1973 Shaffer
3,739,456 A 6/1973 Scherer
4,095,865 A 6/1978 Denison
4,176,033 A 11/1979 Council
4,220,381 A 9/1980 van der Graff
4,345,785 A 8/1982 Bradford
4,366,971 A 1/1983 Lula
4,370,211 A 1/1983 Hybler
4,487,230 A 12/1984 Anthony
4,524,996 A 6/1985 Hunt
4,544,465 A 10/1985 Marsh
4,600,219 A 7/1986 Yoshida
4,688,828 A 8/1987 Shaffer
5,069,485 A 12/1991 Allen
5,320,388 A 6/1994 Lacy
5,725,026 A 3/1998 Maimets
5,906,400 A 5/1999 Gandy
6,250,385 B1 * 6/2001 Montaron ..... 166/207
6,670,880 B1 12/2003 Hall et al.

(Continued)

*Primary Examiner*—Jennifer H. Gay
*Assistant Examiner*—Daniel P Stephenson
(74) *Attorney, Agent, or Firm*—Tyson Wilde

(57) ABSTRACT

A self-expandable cylinder insertable into the bore of a downhole tool includes a resilient material rolled into a substantially cylindrical shape. The outside circumference of the self-expandable cylinder is variable to allow the self-expandable cylinder to be inserted into a narrowed bore of the downhole tool near the box end or pin end. Once past the narrowed bore, the outside circumference of the self-expandable cylinder self-expands within the bore of the downhole tool. The outside circumference of the self-expandable cylinder may expand to contact the inside surface of the bore. In selected embodiments, a transmission line may be routed between the bore and the outside circumference of the resilient material. The self-expandable cylinder may be effective to protect the transmission line from materials traveling through the bore.

21 Claims, 14 Drawing Sheets

U.S. PATENT DOCUMENTS 6,712,556 B2 3/2004 Penza
6,717,550 B1 4/2004 Aisenbrey
6,799,632 B2 10/2004 Hall
6,821,147 B1 11/2004 Hall et al.
6,830,467 B2 12/2004 Hall et al.
6,844,498 B2 1/2005 Hall et al.
6,866,797 B1 3/2005 Martin
2001/0039711 A1 11/2001 Donnelly
2002/0170612 A1 11/2002 Penza
2002/0193004 A1* 12/2002 Boyle et al. ..... 439/577
2004/0104797 A1 6/2004 Hall et al.
2004/0113808 A1 6/2004 Hall et al.
2004/0145492 A1 7/2004 Hall et al.
2004/0150532 A1 8/2004 Hall et al.
2004/0164833 A1 8/2004 Hall et al.
2004/0164838 A1 8/2004 Hall et al.
2004/0216847 A1 11/2004 Hall et al.
2004/0244916 A1 12/2004 Hall et al.
2004/0244964 A1 12/2004 Hall et al.
2004/0246142 A1 12/2004 Hall et al.
2005/0001735 A1 1/2005 Hall et al.
2005/0001738 A1 1/2005 Hall et al.
2005/0035874 A1 2/2005 Hall et al.
2005/0035875 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0046586 A1 3/2005 Hall et al.
2005/0046590 A1 3/2005 Hall et al.
2005/0067159 A1 3/2005 Hall et al.
2005/0070144 A1 3/2005 Hall et al.
2005/0082092 A1 4/2005 Hall et al.
2005/0092499 A1 5/2005 Hall et al.
2005/0093296 A1 5/2005 Hall et al.
2005/0095827 A1 5/2005 Hall et al.
2005/0115717 A1 6/2005 Hall et al.
2005/0145406 A1 7/2005 Hall et al.
2005/0150653 A1 7/2005 Hall et al.
2005/0161215 A1 7/2005 Hall et al.
2005/0173128 A1 8/2005 Hall et al.
2005/0236160 A1 10/2005 Hall et al.
2005/0279508 A1 12/2005 Hall et al.
2005/0284659 A1 12/2005 Hall et al.
2005/0284662 A1 12/2005 Hall et al.
2005/0284663 A1 12/2005 Hall et al.
2005/0285645 A1 12/2005 Hall et al.
2005/0285705 A1 12/2005 Hall et al.
2005/0285706 A1 12/2005 Hall et al.
2005/0285751 A1 12/2005 Hall et al.
2005/0285752 A1 12/2005 Hall et al.
2005/0285754 A1 12/2005 Hall et al.

* cited by examiner

SELF-EXPANDABLE CYLINDER IN A DOWNHOLE TOOL

BACKGROUND

This invention relates to oil and gas drilling, and more particularly to apparatus and methods for reliably transmitting information along downhole drilling strings. In the downhole drilling industry, MWD and LWD tools are used to take measurements and gather information with respect to downhole geological formations, status of downhole tools, conditions located downhole, and the like. Such data is useful to drill operators, geologists, engineers, and other personnel located at the surface. This data may be used to adjust drilling parameters, such as drilling direction, penetration speed, and the like, to accurately tap into oil, gas, or other mineral bearing reservoirs. Data may be gathered at various points along the drill string. For example, sensors, tools, and the like may be located at or near the bottom-hole assembly and on intermediate tools located at desired points along the drill string.

Nevertheless, data gathering and analysis represent only certain aspects of the overall process. Once gathered, apparatus and methods are needed to rapidly and reliably transmit the data to the earth's surface. Traditionally, technologies such as mud pulse telemetry have been used to transmit data to the surface. However, most traditional methods are limited to very slow data rates and are inadequate for transmitting large quantities of data at high speeds.

In order to overcome these limitations, various efforts have been made to transmit data along electrical or other types of cable integrated directly into drill string components, such as sections of drill pipe. In such systems, electrical contacts or other transmission elements are used to transmit data across tool joints or connection points in the drill string. Nevertheless, many of these efforts have been largely abandoned or frustrated due to unreliability and complexity.

For example, one challenge is effectively integrating a transmission line into a downhole tool, such as a section of drill pipe. Due to the inherent nature of drilling, most downhole tools have a similar cylindrical shape defining a bore. The wall thickness surrounding the bore is typically designed in accordance with weight, strength, and other constraints imposed by the downhole environment. In some cases, milling or forming a channel in the wall of the downhole tool to accommodate the transmission line may excessively weaken the wall. Thus, in certain embodiments, the only practical route for the transmission line is through the bore of a downhole tool.

Nevertheless, routing the transmission line through the bore may expose the transmission line to drilling fluids, cements, wireline tools, or other substances or objects passing through the bore. This can damage the transmission line or cause the transmission line to interfere with objects or substances passing through the bore. Moreover, in directional drilling applications, downhole tools may bend slightly as a drill string deviates from a straight path. This may cause the transmission line to deviate away from the inside surface of the bore, thereby worsening the obstruction within the bore.

Thus, apparatus and methods are needed to protect the transmission line, routed through the bore of a downhole tool, from drilling fluids, cement, wireline tools, or other components traveling through the bore.

Further, apparatus and methods are needed to maintain a transmission line against the inside surface of the bore even when the downhole tool bends or deviates from a linear path.

Further, apparatus and methods are needed for lining the inside surface of the bore to isolate a transmission line from objects or substances traveling through the bore.

Further, when dissimilar materials having varying electrical potentials are used, and in some cases when similar materials are used, mechanisms may be needed for protecting the bore wall of the downhole tool from the electrical potential of the apparatus for isolating the transmission line, the apparatus for maintaining the transmission line against the inside surface of the bore wall, and the apparatus for lining the inside surface of the bore wall.

SUMMARY OF THE INVENTION

In view of the foregoing, it is a primary object of the present invention to provide apparatus and methods for protecting a transmission line, routed through the bore of a downhole tool, from drilling fluids, cement, wireline tools, or other components traveling through the bore. If is a further object to maintain a transmission line against the inside surface of the bore even when the downhole tool bends or deviates from a straight path. It is yet a further object to provide apparatus and methods for lining the inside surface of the bore to isolate a transmission line from objects or substances traveling through the bore. Finally, it is an object of this invention to provide a mechanism for protecting the bore wall from the electrical potential of adjacent materials.

Consistent with the foregoing objects, and in accordance with the invention as embodied and broadly described herein, a self-expandable cylinder insertable into the bore of a downhole tool, wherein the bore has a standard circumference along a central portion of the tool, and a constricted circumference near the ends of the downhole tool, is disclosed in one embodiment of the invention as including a resilient material rolled into a substantially cylindrical shape. The outside circumference of the resilient material is variable to allow the resilient material to move through the constricted circumference of the bore. Once past the constricted circumference of the bore, the outside circumference of the resilient material may self-expand within the standard circumference of the downhole tool, that is to say that the self-expandable cylinder is constrained to a circumference of at least a portion of the bore wall.

In selected embodiments, the outside circumference of the resilient material expands to contact the inside surface of the bore wall. In selected embodiments the self-expandable cylinder may be constrained to a diametrical length less than its self-expandable length, and in other selected embodiments, constrained to a diametrical length equal to or greater than its self-expandable length.

In other embodiments, a transmission line may be routed between the bore wall and the outside circumference of the resilient material. The resilient material may keep the transmission line in contact with the inside surface of the bore. The resilient material may also be effective to protect the transmission line from materials traveling through the bore.

In certain embodiments, a channel is formed in the resilient material to accommodate the transmission line. In other embodiments, the resilient material includes two mating surfaces that come together to form the cylindrical shape. Movement between these mating surfaces is effective to cause a change in circumference of the resilient material. In selected embodiments, the mating surfaces are sealed together to prevent substances from leaking into or out of the self-expandable cylinder. In certain embodiments, once the resilient material has expanded within the central portion of the downhole tool, the resilient material is maintained in place by shoulders in the bore.

In another aspect of the invention, a method for lining the bore of a downhole tool, wherein the bore has a central portion of a standard circumference, and tool ends of a constricted circumference, includes rolling a resilient material into a substantially cylindrical shape. Then, the resilient material is inserted into the bore through one of the tool ends into the central portion of the bore. Once in place, the circumference of the resilient material self-expands within the central portion of the bore to reside adjacent the bore wall.

In selected embodiments, the method includes expanding, by the resilient material, the outside circumference of the resilient material to contact the inside surface of the bore. In other embodiments, the method includes routing a transmission line between the bore and the outside circumference of the resilient material. The resilient material may maintain contact between the transmission line and the inside surface of the bore. The resilient material may also protect the transmission line from materials traveling through the bore.

In selected embodiments, the method may include forming a channel in the resilient material to accommodate the transmission line. In other embodiments, the resilient material includes two mating surfaces that mate together to form the cylindrical shape. The circumference of the resilient material may be varied by moving the mating surfaces with respect to one another. In selected embodiments, the method may further include sealing the mating surfaces to one another to prevent substances from leaking into or out of the self-expandable cylinder.

In another aspect of the invention, a method for lining the bore of a downhole tool includes providing a resilient self-expandable cylinder having a substantially cylindrical shape and an outside circumference sized to fit within the bore. The method further includes inserting the resilient self-expandable cylinder into the bore and expanding, by the resilient material, the outside circumference of the resilient material within the bore.

In another aspect of the invention, the bore wall and the self-expandable cylinder may comprise a first and second electrical potential, respectively, and the invention may comprise a mechanism for protecting the bore wall from the second electrical potential of the self-expandable cylinder. The mechanism may comprise an electrical potential more active than the first and second electrical potentials as measured on the seawater Galvanic Series.

BRIEF DESCRIPTION OF THE DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings in which.

DETAILED DESCRIPTION OF THE INVENTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
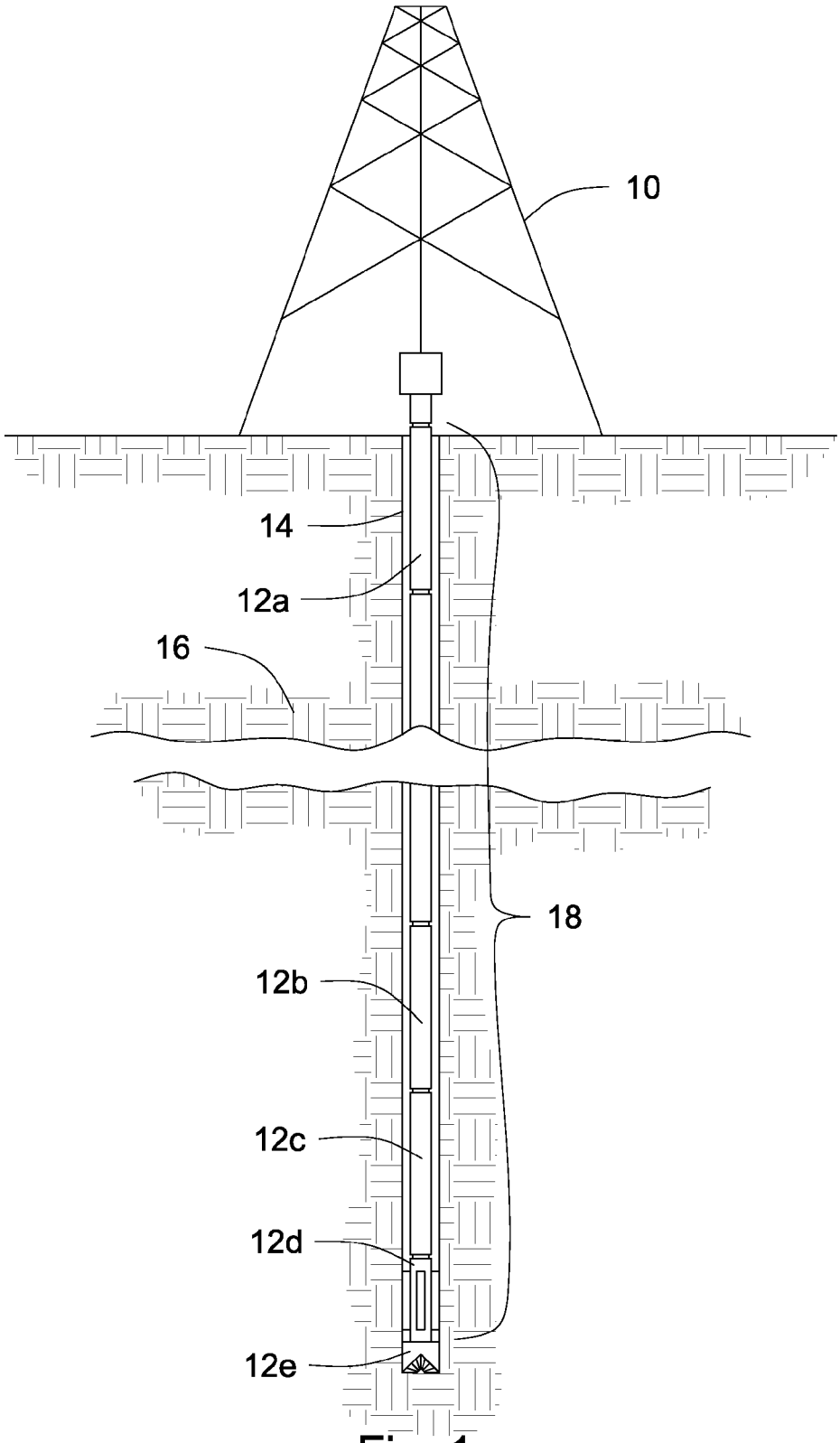
Fig. 1 PRIOR ART
FIG. 1 is a cross-sectional view illustrating one embodiment of a drill rig in accordance with the invention.

Referring to FIG. 1, a cross-sectional view of a drill rig 10 is illustrated drilling a borehole 14 into the earth 16 using downhole tools (collectively indicated by numeral 12) in accordance with the present invention. The collection of downhole tools 12 forms at least a portion of a drill string 18. In operation, a drilling fluid is typically supplied under pressure at the drill rig 10 through the drill string 18. The drill string 18 is typically rotated by the drill rig 10 to turn a drill bit 12*e* which is loaded against the earth 16 to form the borehole 14.

Pressurized drilling fluid is circulated through the drill bit 12*e* to provide a flushing action to carry the drilled earth cuttings to the surface. Rotation of the drill bit may alternately be provided by other downhole tools such as drill motors, or drill turbines (not shown) located adjacent to the drill bit 12*e*. Other downhole tools include drill pipe 12*a* and downhole instrumentation such as logging while drilling tools 12*c*, and sensor packages, (not shown). Other useful downhole tools include stabilizers 12*d*, hole openers, drill collars, heavyweight drill pipe, sub-assemblies, under-reamers, rotary steerable systems, drilling jars, and drilling shock absorbers, which are all well known in the drilling industry.

Figure 2:
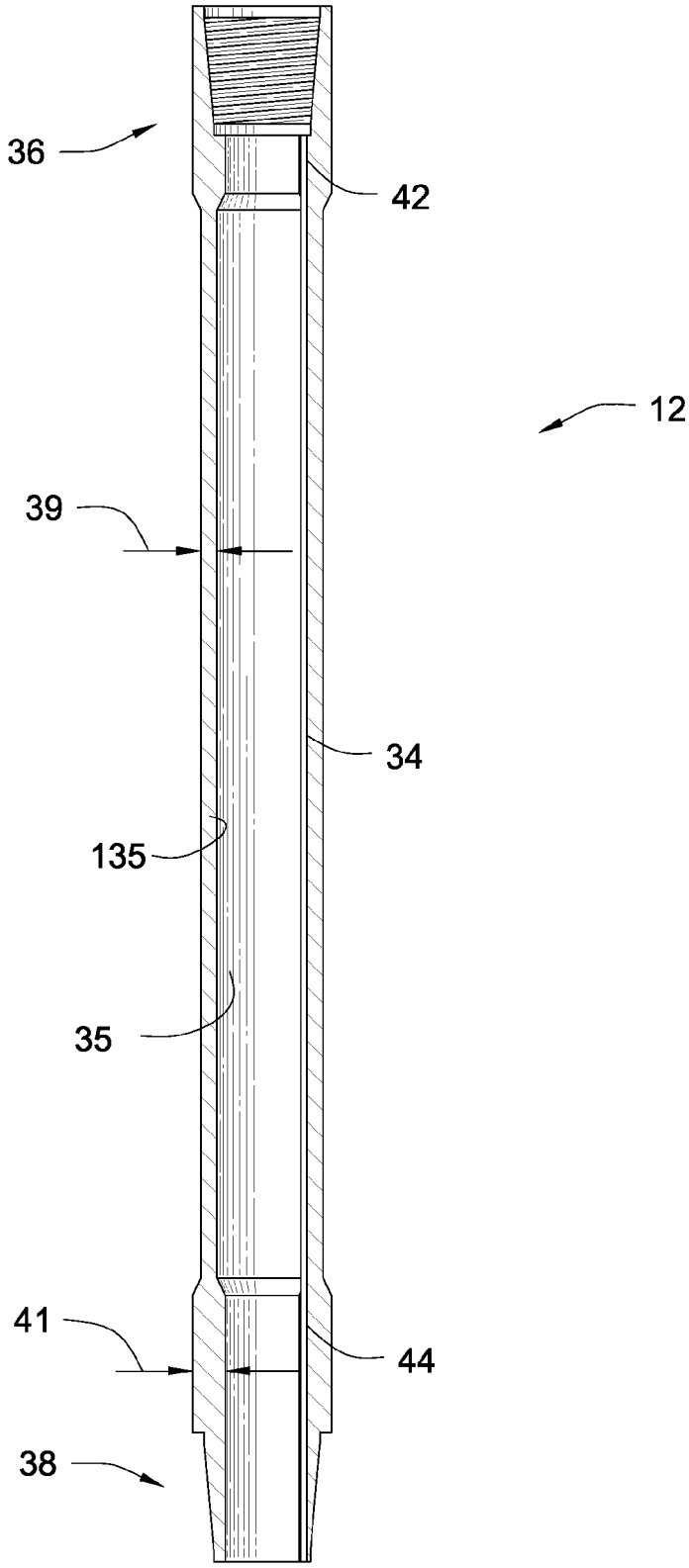
Fig. 2 PRIOR ART
FIG. 2 is a cross-sectional view illustrating one embodiment of a transmission line integrated into a downhole tool.

Referring to FIG. 2, a downhole tool 12 may include a box end 36 and a pin end 38. A pin end 38 may thread into a box end 36, thereby connecting multiple tools 12 together to form a drill string 18. Due to the inherent nature of drilling, most downhole tools 12 are characterized by a similar cylindrical shape defining a bore 35 comprising a bore wall 135, further comprising a first electrical potential as measured on the seawater Galvanic Series. The bore 35 is used to transport drilling fluids, wireline tools, cement, and the like down the drill string 18.

The wall thickness 39 around the bore wall 135 may be designed in accordance with weight, strength, and other constraints, needed to withstand substantial torque placed on the tool 12, pressure within the bore 35, flex in the tool 12, and the like. Because of immense forces placed on the tool 12, milling or forming a channel in the wall 135 of the downhole tool 12 to accommodate a transmission line 34 may excessively weaken the bore wall 135. Thus, in selected embodiments, the only practical route for a transmission line 34 is through the bore 35 of the downhole tool 12.

Nevertheless, routing the transmission line 34 through the bore 35 may expose the transmission line 34 to drilling fluids, cements, wireline tools, or other substances or objects passing through the bore 35. This can damage the transmission line 34 or cause the transmission line 34 to negatively interfere with objects or substances passing through the bore 35. Thus, in selected embodiments, a transmission line 34 is preferably maintained as close to the bore wall 135 of the bore 35 as possible to minimize interference. In selected embodiments, the transmission line 34 is protected by a corrosion resistant conduit 34 or other protective covering 34 to protect it from damage.

As illustrated, at or near the box end 36 and pin end 38 of the tool 12, the bore 35 may be constricted and the walls 41 may be thicker. This may increase the strength of the downhole tool 12 at or near the box end 36 and the pin end 38 tool joints. In addition, this added thickness 41 may enable channels 42, 44 to be milled or formed in the thickened walls 41, to accommodate a transmission line 34 without overly weakening the downhole tool 12. The channels 42, 44 may exit the downhole tool at or near the ends of the downhole tool 12, where the transmission line 34 may be coupled to transmission elements (not shown) for communicating across tool joints.

Figure 3:
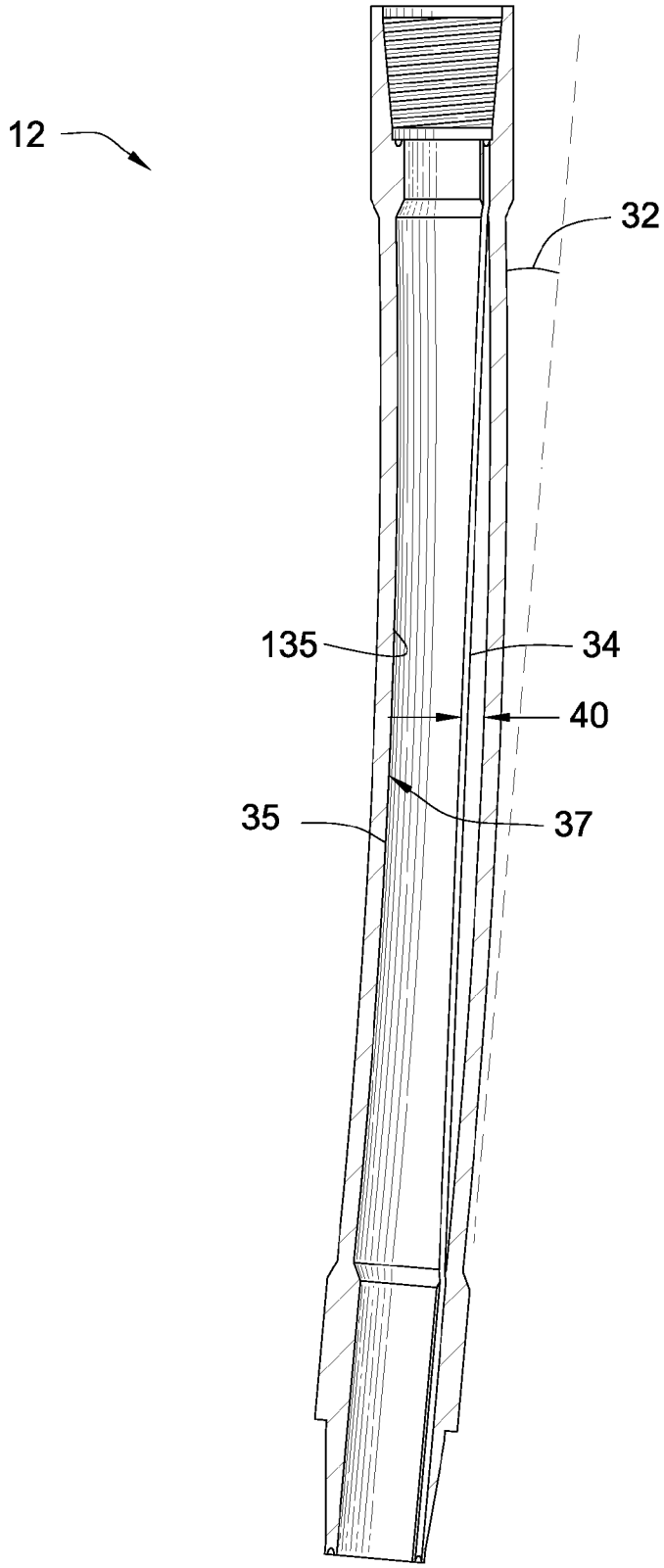
Fig. 3 PRIOR ART
FIG. 3 is a cross-sectional view illustrating one embodiment of a transmission line routed through the bore of a downhole tool when the downhole tool is curved or bent as is customary in directional drilling applications.

Referring to FIG. 3, In an effort to tap into gas, oil, or other mineral deposits, a drill string 18 may be guided or deviate from a linear path. Thus, in selected directional drilling applications, tools 12 may bend to veer off in a desired direction at an angle 32. Since a drill string 18 may consist of many hundreds of sections of drill pipe 12 and other downhole tools 12, the cumulative bend or curve in each tool 12 may enable a drill string 18 to drill horizontally in some cases.

As was previously mentioned, in order to transmit data up and down the drill string 18, a transmission line 34 may be integrated into a downhole tool 12. If the transmission line 34 is routed through the bore 35 of the downhole tool 12, the transmission line 34 may separate or detach from the inside surface of the bore wall 135 when the downhole tool 12 bends. This may create problems since the transmission line 34 may then obstruct or interfere with fluids, wireline tools, concrete, or other objects or substances traveling through the bore. In fact, in some cases, when a downhole tool 12, such as a section of drill pipe 12, bends significantly, the transmission line 34 may actually come into contact with the opposite side 37 of the bore wall 135. Thus, apparatus and methods are needed to route a transmission line 34 through the bore 35 such that the transmission line 34 stays in relatively constant contact with the inside surface of the bore wall 135 even when the downhole tool 12 bends.

Figure 4:
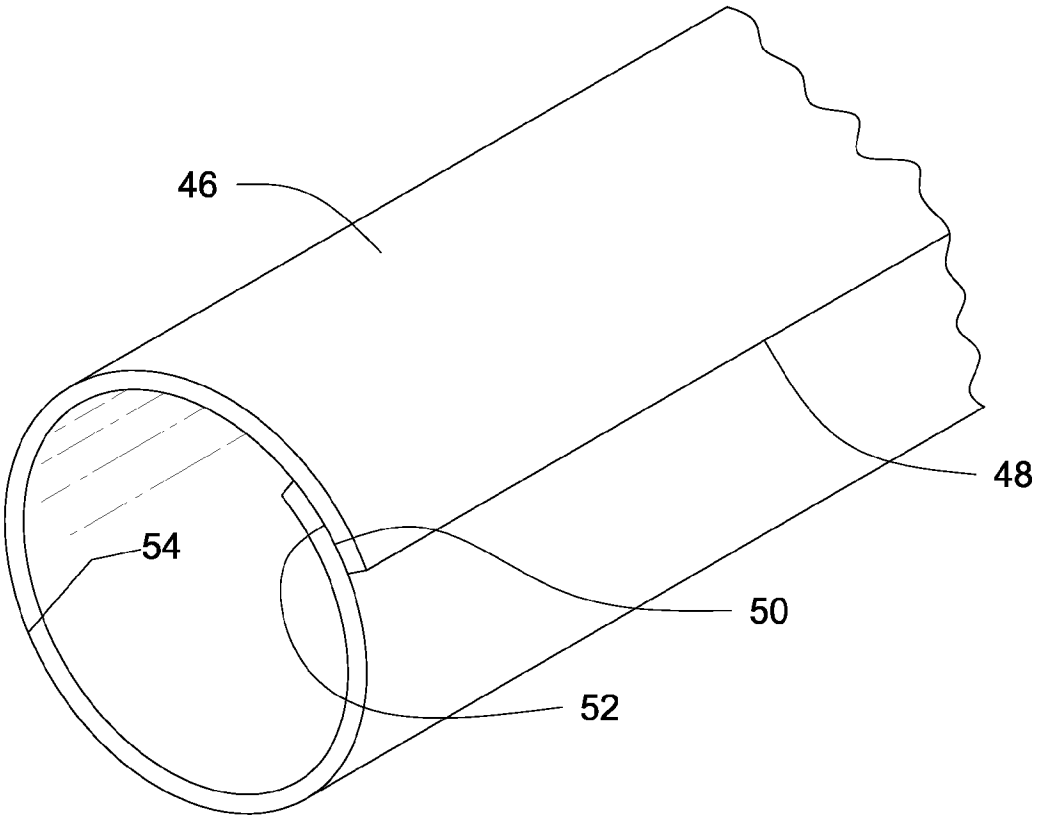
FIG. 4 is a perspective view illustrating one embodiment of a downhole tool self-expandable cylinder in accordance with the invention.

Referring to FIG. 4, in selected embodiments, a self-expandable cylinder 46 comprising a second electrical potential may be provided adjacent the inside surface of the bore wall 135. The self-expandable cylinder 46 may be used to protect or isolate the transmission line 34 from substances or objects passing through the bore 35. As illustrated, a self-expandable cylinder 46 may be formed from a rolled material comprising a second electrical potential and having a substantially cylindrical shape. The self-expandable cylinder 46 may comprise a seal 48 along its length adjacent its mating surfaces 50, 52. The self-expandable cylinder may have a wall thickness between about 0.1 mm and less than about 2.0 mm when combined with a mechanism for protecting the bore wall 135 from the second electrical potential of the self-expandable cylinder.

In selected embodiments, the self-expandable cylinder 46 may include mating surfaces 50, 52 that contact one another to form the cylinder. The mating surfaces 50, 52 may move with respect to one another to roll the self-expandable cylinder 46 more tightly to provide a smaller circumference 54. Thus, the circumference 54 of the self-expandable cylinder may be adjusted as needed to increase or decrease the circumferential length 47 of the cylinder. This may be helpful to initially insert the self-expandable cylinder 46 into the bore 35 of a downhole tool 12, and allow it to expand against the bore wall 135. Once inserted, the cylinder 46 may be constrained to a circumferential length 47 less than, equal to, or greater than its self-expandable length, leaving the mating surfaces 50, 52 in an overlapped position, a substantially butted position, or an open position. The self-expandable cylinder may be constructed of any suitable resilient material comprising an electrical potential as measured on the seawater Galvanic Series capable of withstanding the wear of a downhole environment. For example, the self-expandable cylinder 46 may be constructed of a material such as metal, or an alloy thereof, having sufficient durability and resiliency.

Figure 5:
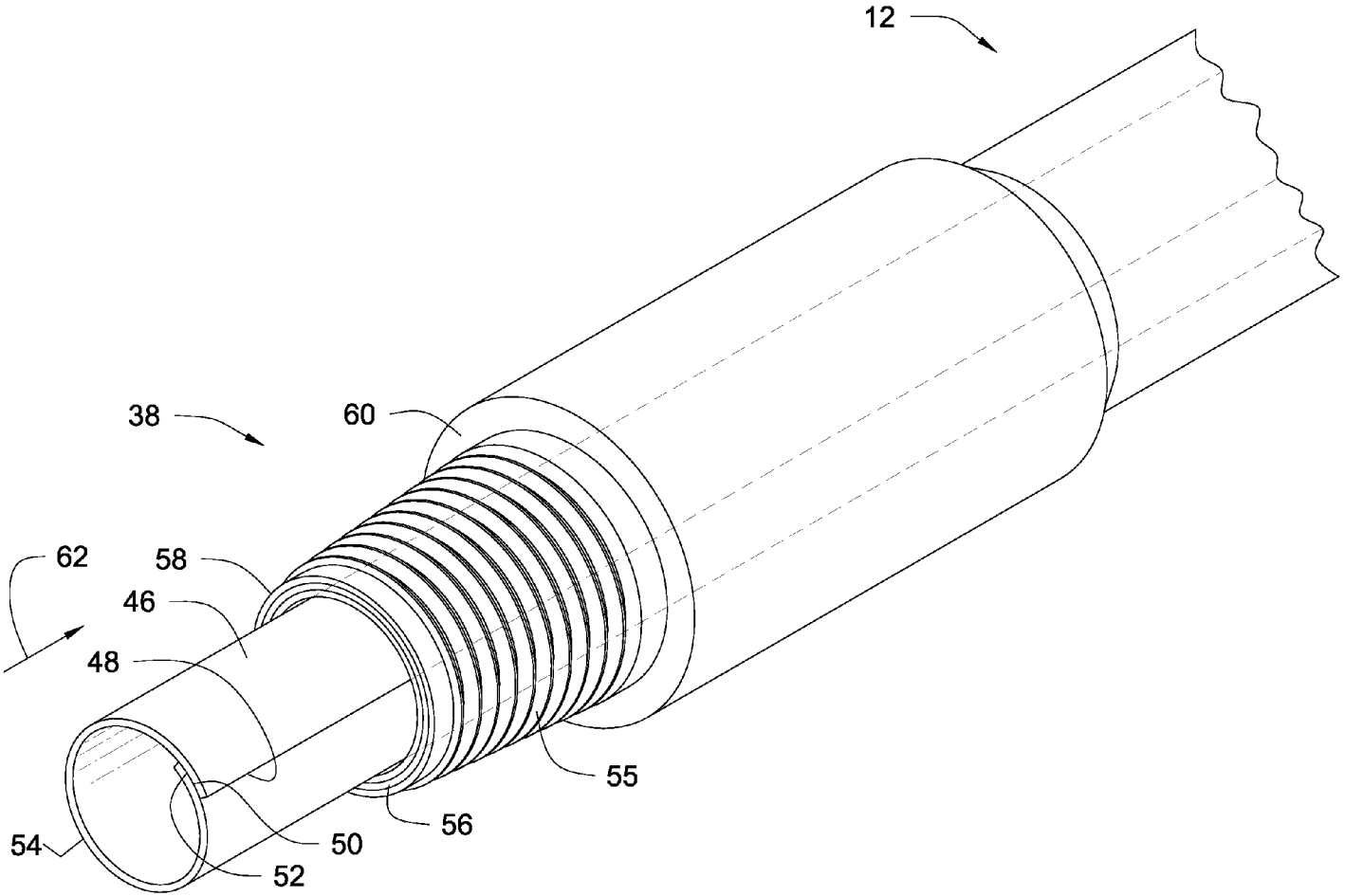
FIG. 5 is a perspective view illustrating one embodiment of a downhole tool self-expandable cylinder in accordance with the invention as it is initially inserted into the bore of a downhole tool.

Referring to FIG. 5, a self-expandable cylinder 46 like that described in FIG. 4 may be inserted into either the box end 36 or pin end 38 of a downhole tool 12. As illustrated, a pin end 38 may include a primary shoulder 60 and secondary shoulder 58, and a threaded portion 55, which may contact another downhole tool 12. The primary shoulder 60 may absorb the majority of the stress at the tool joint. Nevertheless, the secondary shoulder 58 may also absorb some of the stress at the tool joint. The two shoulders 58, 60 together may create a stronger tool joint than either shoulder alone.

As illustrated, a transmission element 56 may be installed into the secondary shoulder 58. The transmission element 56 may be used to transmit a signal across the tool joint by communicating with a corresponding transmission element 56 located on another downhole tool 12 (not shown). The transmission element 56 may transmit energy in several different ways. For example, in selected embodiments, the transmission element 58 may transmit electrical energy by direct electrical contact another transmission element 58 in an adjoining tool.

In other embodiments, the transmission element 58 may communicate inductively. That is, the transmission element 58 may convert an electrical signal to magnetic energy for transmission across the tool joint. The magnetic energy may then be converted back to an electrical signal by another transmission element 58. To accommodate the transmission element 58, a recess may be formed in the secondary shoulder 58. The transmission line 34 may connect to the transmission element 58 through the channels 42/44 in the box and pin end, respectively.

As was previously mentioned, the bore 35 traveling through the pin end 38 may be constricted more than the bore 35 traveling through the central portion of the tool 12. Thus, in order to insert the self-expandable cylinder 46 into the downhole tool 12, the circumference 54, and circumferential length 47, of the self-expandable cylinder 46 may be reduced. This may be accomplished by rolling the self-expandable cylinder 46 into a smaller circumference cylinder. The self-expandable cylinder 46 may then be inserted in a direction 62 into the downhole tool 12. In selected embodiments, the self-expandable cylinder 46 may be lubricated to facilitate sliding the self-expandable cylinder 46 into the tool 12.

Figure 6:
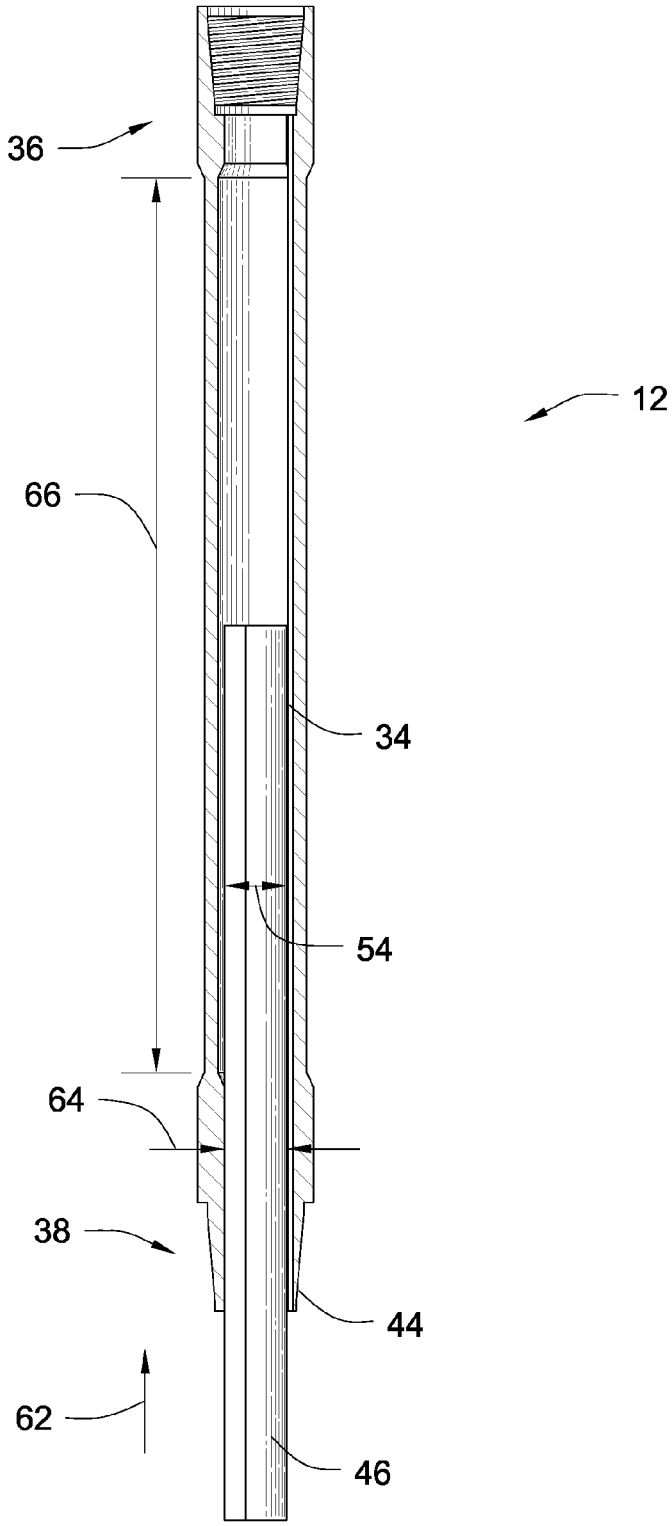
FIG. 6 is a cross-sectional view illustrating one embodiment of a downhole tool self-expandable cylinder as it is initially inserted into the bore of a downhole tool.

Referring to FIG. 6, a cross-sectional view of a self-expandable cylinder 46 is illustrated as it is inserted into a downhole tool 12. As shown, the self-expandable cylinder 46 may be inserted with an initial circumference 54 so it can slide through the constricted bore 64 in either the box end 36 or pin end 38. The self-expandable cylinder 46 may be cut to a specified length 66 to fit within a central portion 66 of the downhole tool 12.

Figure 7:
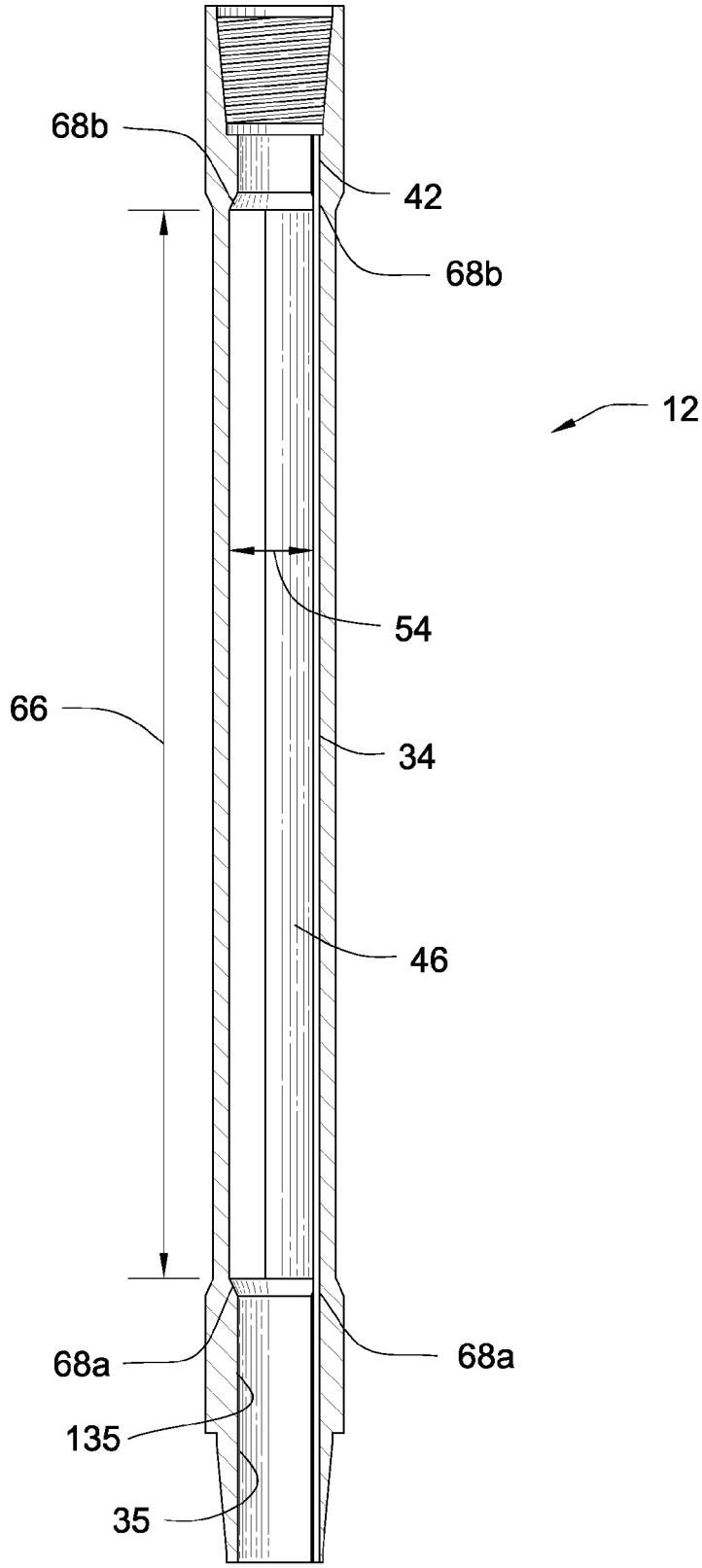
FIG. 7 is a cross-sectional view illustrating one embodiment of a downhole tool self-expandable cylinder after it expands into the larger circumference of the bore.

Referring to FIG. 7, once the self-expandable cylinder 46 reaches the central portion 66 of the bore 35, the circumference 54 of the self-expandable cylinder 46 may increase to contact the inside surface of the bore 35. As was previously described, the self-expandable cylinder 46 may self-expand within the bore 35 due to its resiliency. For example, if the self-expandable cylinder 46 is a sheet of a resilient material rolled into a cylindrical shape, the circumference 54 of the self-expandable cylinder 46 may automatically expand due to its resiliency so as to be disposed adjacent the bore wall 135.

Once the circumference 54 of the self-expandable cylinder 46 has expanded to contact the inside surface of the bore wall 135, the self-expandable cylinder 46 may kept in place 12 by shoulders 68*a*, 68*b* near the box and pin ends 36, 38. The shoulders 68*a*, 68*b* may be present where the bore 15 narrows near the box end 36 and pin end 38. Likewise, the resiliency of the self-expandable cylinder 46 may keep the self-expandable cylinder 46 from slipping past the shoulders 68*a*, 68*b*. In selected embodiments, the more resilient the material 46, the better the retention between the shoulders 68*a*, 68*b*.

It is important to securely retain the self-expandable cylinder 46 between the shoulders 68*a*, 68*b*. For example, if the self-expandable cylinder 46 slips past the shoulders 68*a*, 68*b*, the self-expandable cylinder 46 may create an obstruction within the bore 15. This may cause the drill string to malfunction, possibly causing time-consuming and costly delays. In other embodiments, the self-expandable cylinder 46 may be welded or otherwise bonded to the inside of the downhole tool 12 to keep it from moving.

Figure 8:
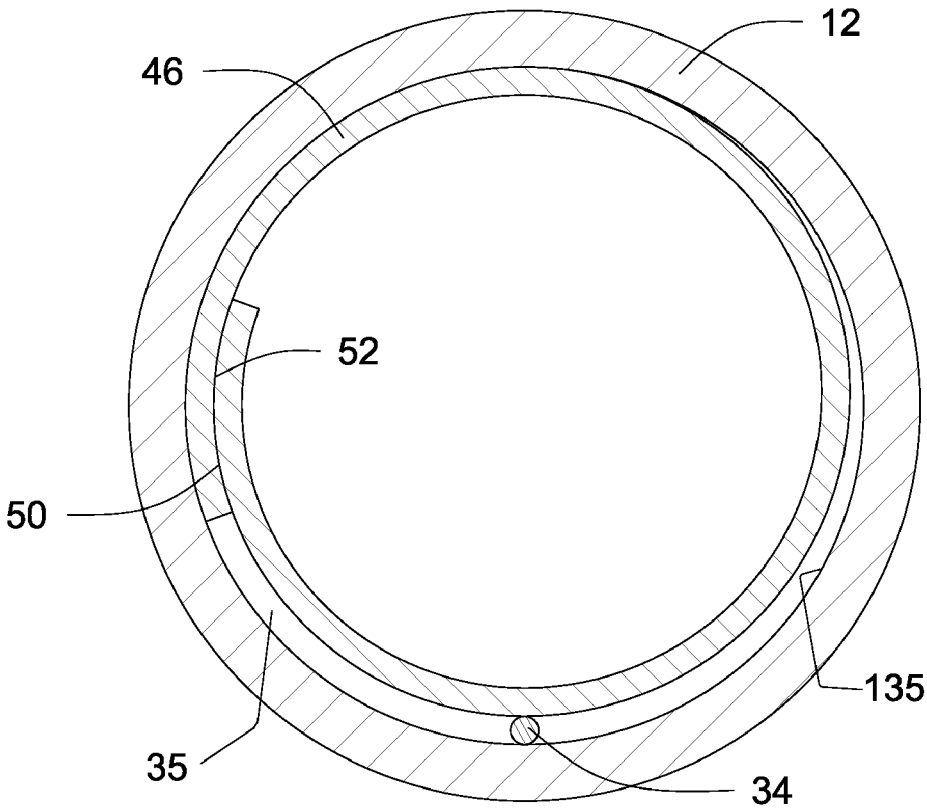
FIG. 8 is a cross-sectional view illustrating one embodiment of a downhole tool self-expandable cylinder within the bore of a downhole tool, wherein the self-expandable cylinder is used to isolate a transmission line from objects or substances passing through the bore.

Referring to FIG. 8, a cross-sectional view of the central portion 66 of a downhole tool 12 is illustrated. As shown, the transmission line 34 may be sandwiched between the self-expandable cylinder 46 and the surface of the bore wall 135. This may protect the transmission line 34 from objects or substances passing through the bore 35. In selected embodiments, the mating surfaces 50, 52 may be sealed together in order to prevent fluids or other substances from leaking from the self-expandable cylinder 46. In other embodiments, the mating surfaces 50, 52 may be left unsealed.

Figure 9:
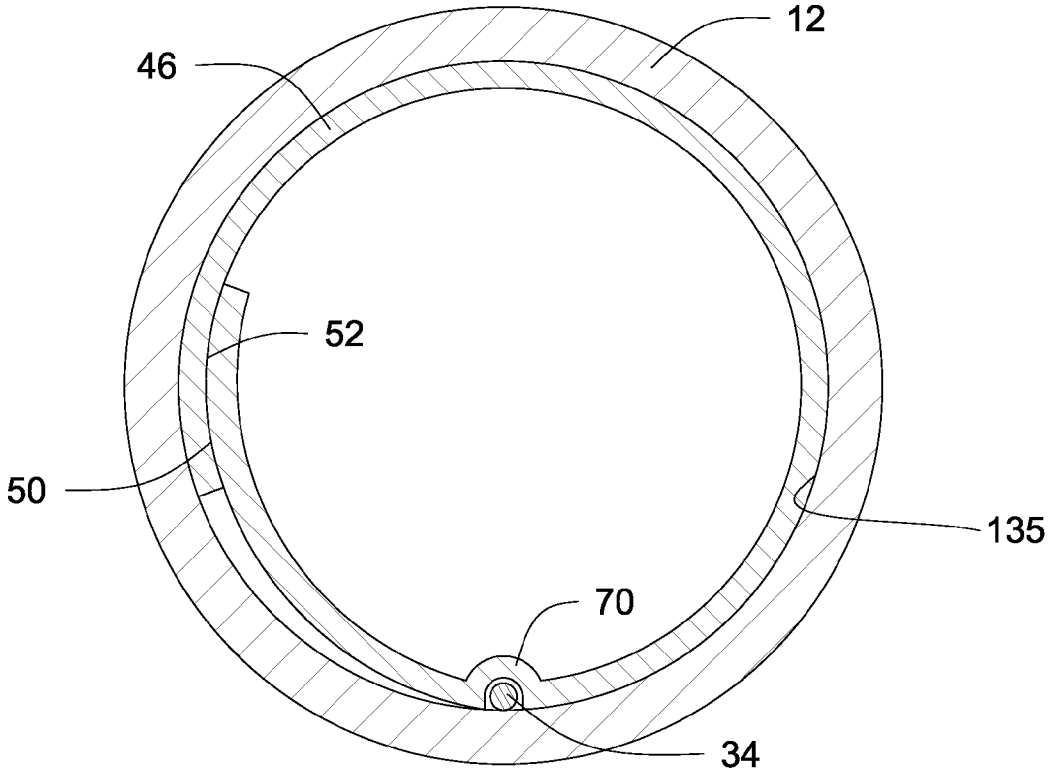
FIG. 9 is a cross-sectional view illustrating one embodiment of a downhole tool self-expandable cylinder inserted into the bore of a downhole tool, wherein the self-expandable cylinder includes a channel to accommodate a transmission line.

Referring to FIG. 9, in other embodiments, a channel 70 may be formed in the self-expandable cylinder 46 to accommodate the transmission line 34. The channel 70 may maintain the transmission line 34 in place and provide better contact between the self-expandable cylinder 46 and inside surface of the bore wall 135.

Figure 10:
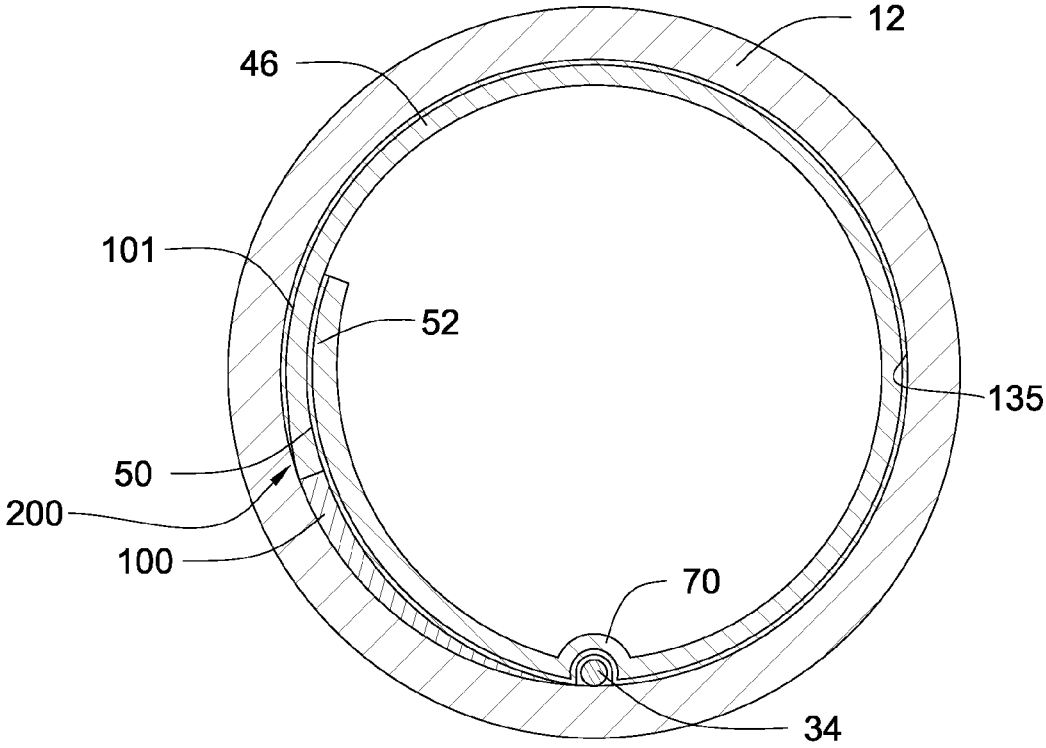
FIG. 10 is a cross-sectional view illustrating mechanisms for protecting the bore wall from the electrical potential of the self-expandable cylinder.

Referring to FIG. 10, it may be preferable that the bore wall 135 and the self-expanding cylinder 46 comprise electrical potentials within overlapping ranges as a mechanism for protection against corrosion. However, in some embodiments when the bore wall 135 and the self-expandable cylinder 46 are comprised of dissimilar metallic materials, the respective electrical potentials may not be within overlapping ranges, then the downhole tool may comprise a mechanism for protecting the bore wall 135 from the electrical potential of the self-expandable cylinder.

Metals and metal alloys have unique electrical potentials as measured on the seawater Galvanic Series which may be used to predict their effect on one another when placed in electrical contact in a moist environment. When dissimilar metallic materials are positioned adjacent one another in the presence of moisture, a galvanic couple may be formed causing the more active metal material as measured on the seawater Galvanic Series to lose electrons, or corrode. Therefore, the presence of the self-expandable cylinder 46 adjacent to the bore wall 135 may create a galvanic couple when the downhole tool is placed into service in a tool string where moisture from the subterranean formations and in the drilling fluids circulates around and through the borehole and in the bore 35 of the tool. Even when similar metals are used for the bore wall and the self-expandable cylinder, corrosion may occur due to the effects of the chemicals used in the drilling fluid and the chemical properties of the subterranean fluids encountered during drilling which may alter the electrical potential of either the bore wall or the cylinder.

Therefore, it may be desirable that a mechanism for protecting the downhole tool from corrosion be provided, especially when the self-expanding cylinder in used in the downhole tool. In order to preserve the integrity of the downhole tool, it would be preferable for the self-expandable cylinder 46 to be more active and susceptible to the loss of electrons and corrosion instead of the bore wall 135 of the tool. It may be preferable that the average difference between the first electrical potential of the bore wall 135 and second electrical potential of the cylinder 46 be less than about 1.9, preferably less than about 1.5, and more preferably less than 0.5, but greater than 0.1.

The mechanism may include materials such as zinc, magnesium, aluminum, cadmium, or cast iron, or combinations or alloys thereof, when the bore wall is comprised of steel or stainless steel.

When the bore wall 135 comprises a steel and the cylinder 46 comprises stainless steel, then the bore wall would be more active on the seawater Galvanic Series and more susceptible to the loss of electrons and corrosion. The mechanism for protecting the bore wall 135, comprising a first electrical potential, from the effects of the second electrical potential of the self-expandable cylinder may comprise an electrically insulating barrier 101 between the self-expandable cylinder 46 the bore wall 135, thus slowing down or preventing the loss of electrons from the bore wall and the cylinder. The electrically insulating barrier 101 may comprise a non-electrically conductive coating applied to the either or both the mating surfaces of the bore wall 135 and the cylinder 46. Only coating the outside surface of the self-expandable cylinder 46 is the preferred mechanism for providing such insulating baffler, so that the coated surface of the cylinder may be in contact with uncoated surface of the bore wall. The least preferred mechanism may be coating the bore wall 135 and leaving the cylinder 46 uncoated. Another mechanism may be to provide a greater uncoated surface on the bore wall 135 in contact with a lesser uncoated surface 200 on the cylinder 46. Additionally, the mechanism may comprise a discrete electrically insulating barrier 100 provided intermediate at least a portion of the matching surfaces of the bore wall 135 and the self-expandable cylinder 46.

Another mechanism for protecting the bore wall 135 from the electrical potential of the self-expanding cylinder 46 may be the use of a self-expanding cylinder that comprises a second electrical potential that is more active than the first electrical potential of the bore wall, as measured on the seawater Galvanic Series, thereby assuring that the cylinder 46 corrodes in preference to the bore wall 135. However, as noted earlier, the chemical properties of the fluids encountered downhole may alter the electrical potential of either or both of the bore wall 135 and the cylinder 46. Under such conditions, it may be desirable to provide an alternate mechanism for protecting the bore wall.

Figure 11:
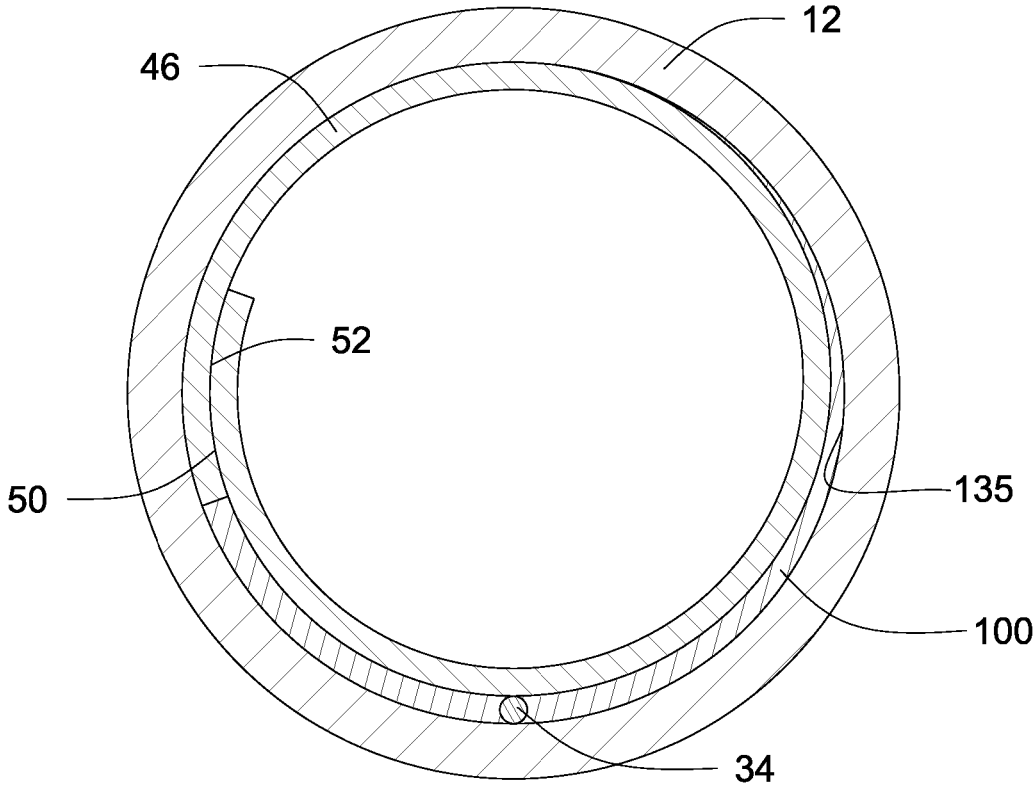
FIG. 11 is a cross-section view illustrating another mechanism for protecting the bore wall from the electrical potential of the self-expandable cylinder.

Referring to FIG. 11, a cross-sectional view of the downhole tool 12 is shown with the bore wall 135 depicted adjacent the self-expandable cylinder 46. A discrete insulating barrier 100 may be positioned intermediate at least a portion of the bore wall 135 and the cylinder 46. In this embodiment of the present invention, the discrete insulating barrier comprises an electrical potential more active, as measured on the seawater Galvanic Series, than the first electrical potential of the bore wall 135 and the second electrical potential of the cylinder 46. In this embodiment, the discrete insulating barrier would corrode in preference to the bore wall and the cylinder, thereby protecting them from the effects of their respective electrical potentials in relation to each other. The discrete insulating barrier used to protect both the bore wall 135 and the cylinder 46 may enable the use of thin walled material for the cylinder 46. Thin walled material on the order of between about 0.1 mm to about less than 2.0 mm may be suitable for fixing the electrical conduit against the bore wall, since the cylinder may be protected from the electrical potential of the bore wall.

Figure 12:
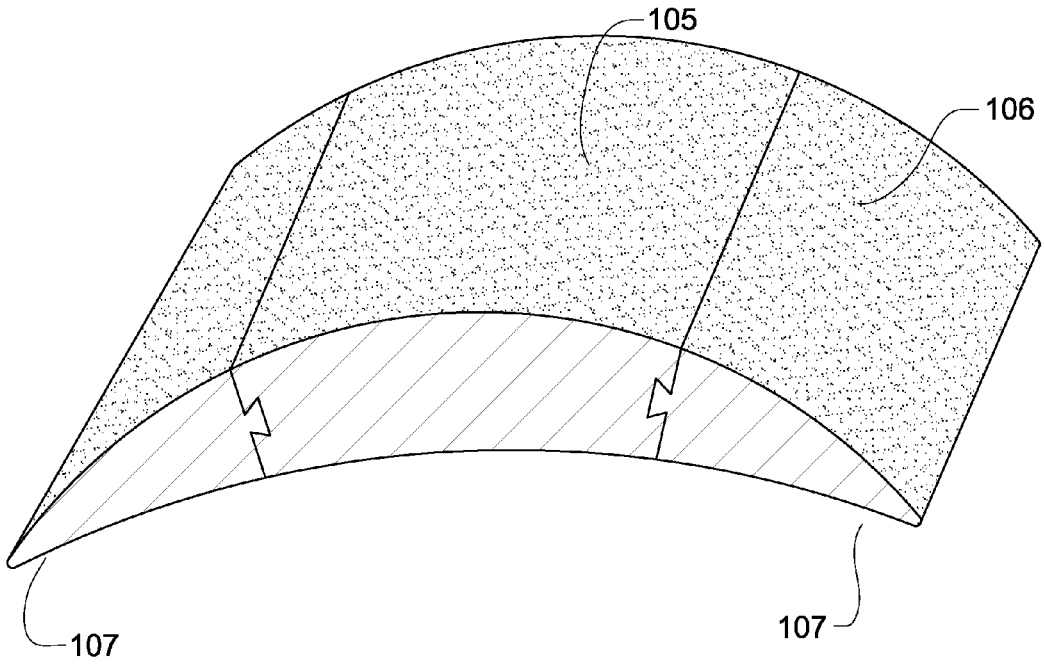
FIG. 12 is a perspective view of a mechanism for protecting the bore wall from the electrical potential of the self-expandable cylinder.

Referring to FIG. 12, a perspective view of a discrete insulating barrier is illustrated. The insulating barrier may comprise one or more segments 105,106 and may be tapered at the ends 107 in order to accommodate at least a portion of a gap between the bore wall 135 and the self-expandable cylinder 46. The barrier 105 may be a sleeve preformed to match the inside surface of the bore wall 135 and positioned adjacent the cylinder 46. The barrier 105, 106 may comprise an electrical potential more active on the seawater Galvanic Series than the bore wall 135 and the cylinder 46. Further, the barrier may comprise an electrically insulating coating as discussed earlier as a measure of added protection.

Figure 13:
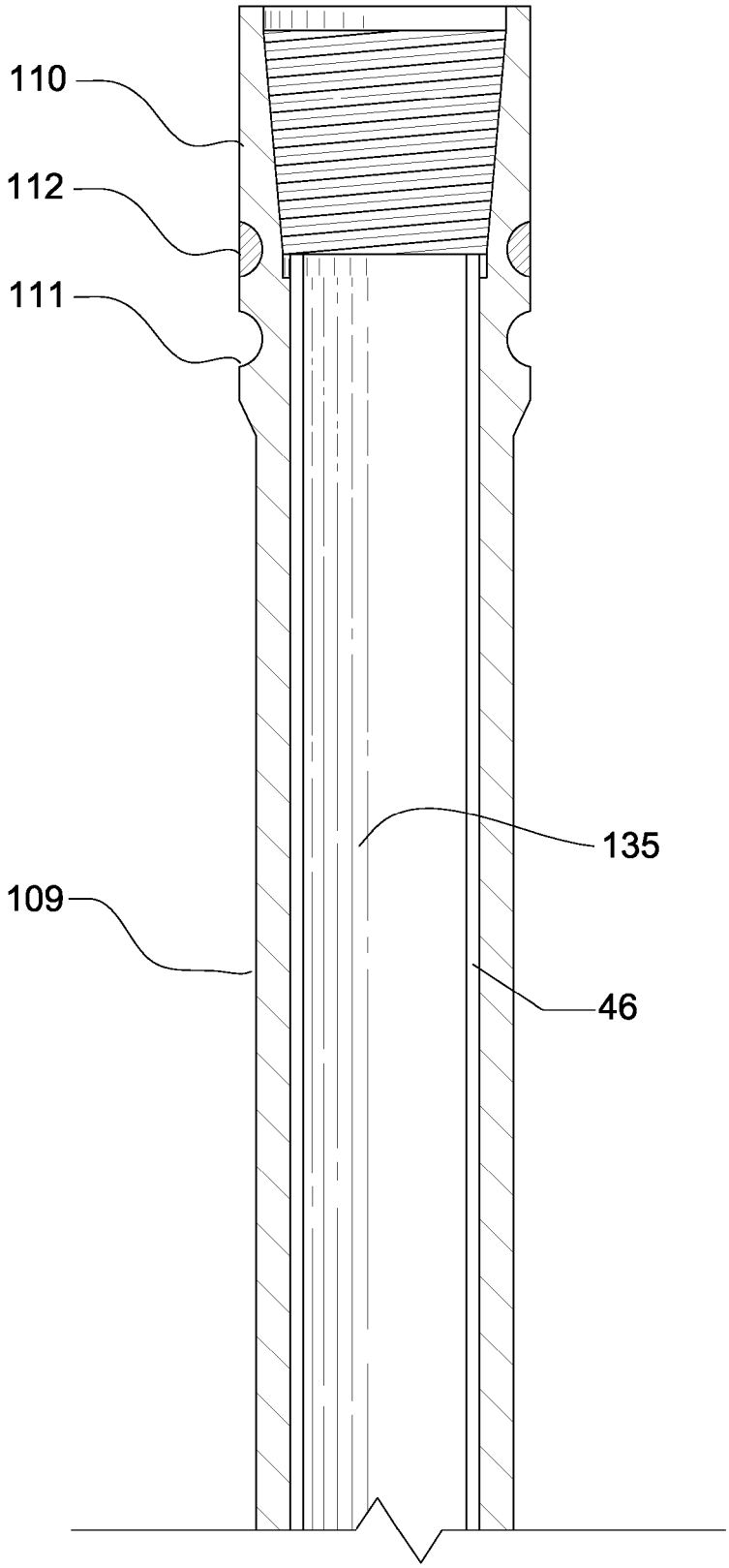
FIG. 13 is a cross-section view illustrating another mechanism for protecting the bore wall from the electrical potential of the self-expandable cylinder.

Referring to FIG. 13, a cross-sectional view of a box end tool joint 109 is depicted. The tool joint 109 comprises a threaded portion 110 for connection in a downhole tool string. The tool joint 109 further comprises circumferential recesses 111 formed in the outer wall of the joint. One of the recesses 112 comprises a mechanism for protecting the bore wall 135 from the electrical potential of the self-expandable cylinder 46. The mechanism comprises an electrical potential more active on the seawater Galvanic Series than the bore wall 135 and the self-expandable cylinder 46. For example, if the bore wall were comprised of a carbon steel and the cylinder were comprised of a stainless steel, the mechanism may be comprised of zinc, aluminum, magnesium, cast iron, or cadmium, or combinations or alloys thereof, which may be more active than the steel and the stainless steel as measured by the seawater Galvanic Series. In this embodiment, the Zinc, etc., may corrode in preference to the steel and the stainless steel thereby protecting the bore wall 135 and the cylinder 46 from the effects of their respective electrical potentials in the downhole environment.

Figure 14A:
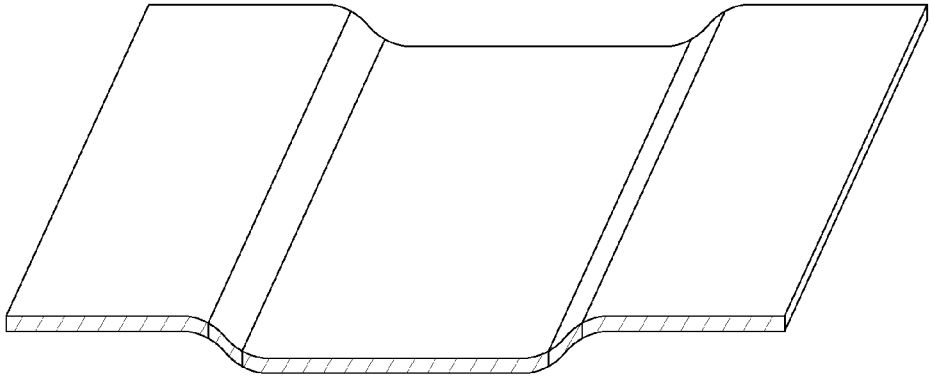
FIG. 14 is a perspective view illustrating a self-expandable cylinder pre-formed to approximate the constrictions of the bore wall.
Figure 14B:
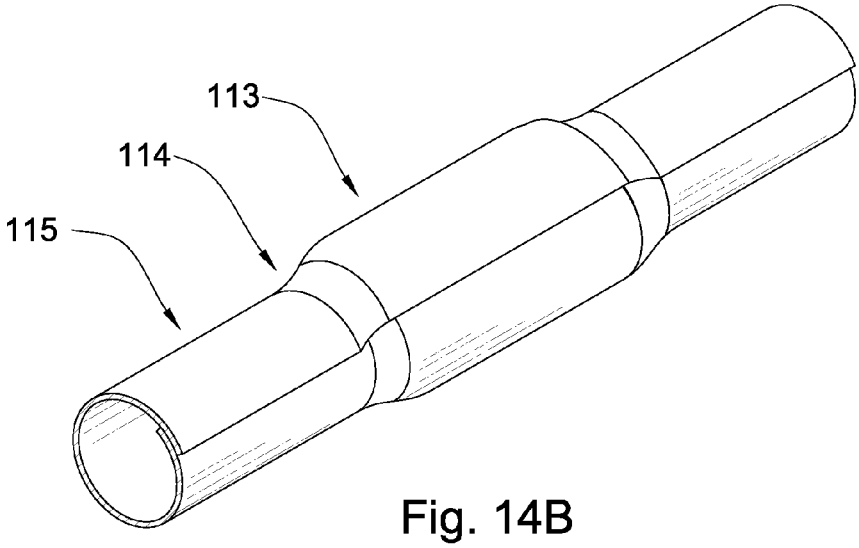

Referring to FIG. 14, a perspective view of a preformed self-expandable cylinder 46 is depicted. The cylinder 46 features center region 113, a transition region 114, and a constricted region 115. The cylinder 46 may be preformed to match the inside configuration of the bore wall in some downhole tools. Preforming the cylinder 46 may facilitate its insertion into the downhole tool and may provide a better fit between the inside bore wall and the cylinder. Further, a preformed cylinder may be desirable when in addition to the allowing the cylinder to self-expand against the bore wall, it is mechanically or hydraulically deformed in situ in order to increase its fit against the bore wall and provide a more durable attachment of the transmission line.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. A downhole tool, comprising:

a bore wall comprising an inside circumference and a first electrical potential;

a self-expandable cylinder comprising a second electrical potential;

the self-expandable cylinder being disposed within and constrained to the inside circumference of at least a portion of the bore wall, and a mechanism for protecting the bore wall from the electrical potential of at least a portion of the self expandable cylinder;

wherein the mechanism for protection of the bore wall comprises an electrically insulating coating on the outside surface of the self expandable cylinder wherein the mechanism comprises a greater uncoated surface on the bore wall in electrical contact with a lesser uncoated surface on the self expandable cylinder.

2. The downhole tool of claim 1, wherein the self expandable cylinder is constrained to a circumferential length less than its self expandable length.

3. The downhole tool of claim 1, wherein the self expandable cylinder is constrained to a circumferential length at least as great as its self expandable length.

4. The downhole tool of claim 1, wherein the bore wall comprises one or more constrictions.

5. The downhole tool of claim 1, wherein at least a portion of the self-expandable cylinder is deformed in situ to match the constrictions in the bore wall.

6. The downhole tool of claim 1, wherein the self-expandable cylinder is preformed to approximate the constrictions in the bore wall.

7. The downhole tool of claim 1, wherein at least a portion of the self-expandable cylinder is in electrical contact with at least a portion of the bore wall.

8. The downhole tool of claim 1, wherein the self-expandable cylinder has a wall thickness of between about 0.1 mm and less than about 2.0 mm.

9. The downhole tool of claim 1, wherein the mechanism for protecting the bore wall comprises the first electrical potential and the second electrical potential being within overlapping ranges as measured on the seawater Galvanic Series.

10. The downhole tool of claim 1, wherein the mechanism for protecting the bore wall comprises the first electrical potential and the second electrical potential being not within overlapping ranges on the seawater Galvanic Series.

11. The downhole tool of claim 10, wherein the mechanism for protecting the bore wall comprises an average difference between the electrical potential of the bore wall and that of the self-expandable cylinder being less than about 1.9, preferably less than about 1.5, and more preferably less than about 0.5, but greater than about 0.1, as measured on the seawater Galvanic Series.

12. The downhole tool of claim 1, wherein the mechanism for protection of the bore wall comprises the bore wall being less active than the self-expandable cylinder as measured on the seawater Galvanic Series.

13. The downhole tool of claim 1, wherein the bore wall is more active than the self-expandable cylinder as measured on the seawater Galvanic Series.

14. The downhole tool of claim 13, wherein the mechanism for protection of the bore wall comprises one or more materials more active than the bore wall and the self-expandable cylinder as measured on the seawater Galvanic Series being disposed in electrical contact with the bore wall and the self-expandable cylinder.

15. The downhole tool of claim 13, wherein the mechanism for protection of the bore wall comprises one or more materials more active than the bore wall and the self-expandable cylinder as measured on the seawater Galvanic Series being disposed within recesses about the exterior of the downhole tool.

16. The downhole tool of claim 13, wherein the mechanism for protection of the bore wall comprises one or more materials more active than the bore wall and the self-expandable cylinder as measured on the seawater Galvanic Series being disposed intermediate at least a portion of the bore wall and at least a portion of the self-expandable cylinder.

17. The downhole tool of claim 13, wherein the mechanism for protection of the bore wall comprises one or more preformed materials more active than the bore wall and the self-expandable cylinder as measured on the seawater Galvanic Series being disposed intermediate at least portion of the bore wall and at least a portion of the self-expandable cylinder.

18. The downhole tool of claim 13, wherein the mechanism for protection of the bore wall comprises an electrical insulating barrier disposed intermediate the bore wall and the self-expandable cylinder.

19. The downhole tool of claim 1, wherein the mechanism for protection of the bore wall comprises a coated outside surface of the self-expandable cylinder being in contact with an uncoated surface of the bore wall.

20. The downhole tool of claim 1, wherein the mechanism for protection of the bore wall comprises an electrically insulating coating on the bore wall.

21. The downhole tool of claim 1, wherein the self-expandable cylinder comprises a seal intermediate mating ends of the self-expandable cylinder.

* * * * *